US008991503B2

(12) United States Patent
Fenton

(10) Patent No.: US 8,991,503 B2
(45) Date of Patent: Mar. 31, 2015

(54) SUBSEA WELLHEAD ASSEMBLY

(75) Inventor: Stephen Paul Fenton, Aberdeenshire (GB)

(73) Assignee: Vetco Gray Inc., Houston, TX (US)

( * ) Notice: Subject to any disclaimer, the term of this patent is extended or adjusted under 35 U.S.C. 154(b) by 112 days.

(21) Appl. No.: 13/469,563

(22) Filed: May 11, 2012

(65) Prior Publication Data

US 2012/0318518 A1 Dec. 20, 2012

(30) Foreign Application Priority Data

May 13, 2011 (EP) ..... 11166089

(51) Int. Cl.
*E21B 33/043* (2006.01)

(52) U.S. Cl.
CPC ..... *E21B 33/043* (2013.01)
USPC ..... 166/351; 166/340; 166/365; 166/368

(58) Field of Classification Search
CPC ..... E21B 33/043; E21B 33/035; E21B 34/04
USPC ..... 166/351, 338–340, 344, 347, 348, 360, 166/365, 368, 378, 381, 382, 85.1, 75.14; 285/123.1
See application file for complete search history.

(56) References Cited

U.S. PATENT DOCUMENTS 5,456,313 A * 10/1995 Hopper et al. ..... 166/97.1
6,076,605 A * 6/2000 Lilley et al. ..... 166/368
6,357,529 B1 * 3/2002 Kent et al. ..... 166/344
6,394,194 B1 * 5/2002 Queen et al. ..... 175/66
6,481,504 B1 * 11/2002 Gatherar ..... 166/344
6,705,401 B2 * 3/2004 Buckle et al. ..... 166/337
6,755,254 B2 * 6/2004 DeBerry ..... 166/368
6,902,005 B2 * 6/2005 Radi et al. ..... 166/345
6,966,383 B2 * 11/2005 Milberger et al. ..... 166/368
7,416,025 B2 * 8/2008 Bhat et al. ..... 166/355
8,371,385 B2 * 2/2013 Lewis ..... 166/368
2005/0121198 A1 * 6/2005 Andrews ..... 166/368
2005/0205262 A1 * 9/2005 Reimert et al. ..... 166/348
2008/0006412 A1 1/2008 Ford
2010/0025044 A1 * 2/2010 McKay et al. ..... 166/359
2010/0206588 A1 * 8/2010 Nguyen ..... 166/387

FOREIGN PATENT DOCUMENTS

WO 00/47864 A1 8/2000
WO 01/81710 A1 11/2001

OTHER PUBLICATIONS

EP Search Report from corresponding EP Patent Application 11166089.0 Date as Nov. 11, 2011.

* cited by examiner

*Primary Examiner* — Matthew Buck
(74) *Attorney, Agent, or Firm* — GE Global Patent Operation

(57) ABSTRACT

A subsea wellhead assembly is provided. The subsea wellhead assembly comprises a tubing head structure with a tree above the tubing head structure, and a recoverable module attached to the tubing head structure below said tree, the recoverable module comprising at least one valve and at least one sensor.

15 Claims, 1 Drawing Sheet

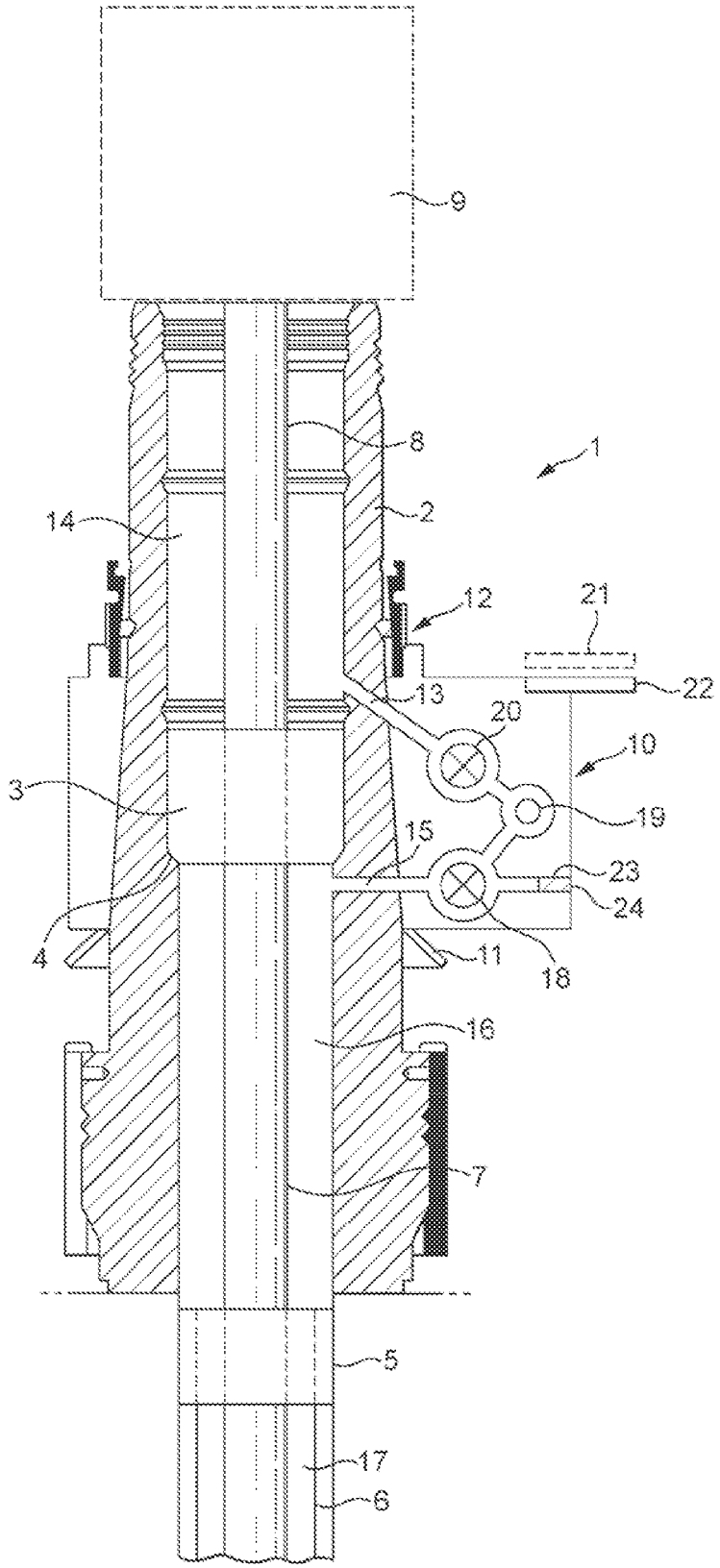
9
8
1
14
2
12
21
22
13
20
10
3
19
15
23
24
4
11
18
16
7
5
17
6

SUBSEA WELLHEAD ASSEMBLY

BACKGROUND OF THE INVENTION

1. Field of the Invention

The present disclosure relates to a subsea wellhead assembly.

2. Description of Related Art

In the event of a problem in the operation of a subsea well, after the well has been secured, it may be necessary to remove to the topside not only a tree, but also a tubing head structure and its associated equipment. Known subsea wellhead assemblies contain an integrated tree and tubing head structure.

BRIEF SUMMARY OF THE INVENTION

According to an embodiment of the present invention, there is provided a subsea wellhead assembly. The subsea wellhead assembly comprises a tubing head structure with a tree above the tubing head structure, and a recoverable module attached to the tubing head structure below the tree, the recoverable module comprising at least one valve and at least one sensor.

According to another embodiment of the present invention, there is provided a method of operating a subsea well comprising a subsea wellhead assembly comprising a tubing head structure with a tree above the tubing head structure, and a recoverable module attached to the structure below the tree, the recoverable module comprising at least one valve and at least one sensor. The method comprises removing the tree if a problem occurs in the operation of the subsea well, and, thereafter, removing the recoverable module from the tubing head structure.

BRIEF DESCRIPTION OF THE DRAWING

FIG. 1 is a schematic longitudinal section through a subsea wellhead assembly according to an embodiment of the present invention.

DETAILED DESCRIPTION OF THE INVENTION

FIG. 1 shows a longitudinal section through a subsea wellhead assembly 1 according to an embodiment of the invention. The wellhead assembly 1 includes a tubing head structure in the form of a tubing head spool 2, typically in the form of a circular round forging, mounted on a subsea wellhead. Inside the spool 2 is a tubing hanger 3 mounted by suitable means such as by being on a load shoulder 4 formed in the spool 2 as shown or on a retractable load shoulder. Below the tubing hanger 3 there is a casing hanger 5 in the wellhead in a conventional manner, from which is suspended in at least one string of casing 6.

The tubing hanger 3 carries lower production tubing 7 extending into the well and inside the casing string 6, upper production tubing 8 in the form of a production stab extending to a tree schematically indicated by block 9, the tree 9 being a so-called "vertical tree".

Attached around the tubing head spool 2 is a recoverable module 10 sitting on a shoulder in the form of a support ring 11 around the tubing head spool 2, the module 10 being attached to the latter by an attachment arrangement 12. An upper annulus port 13 opens into the annular space 14 between upper production tubing 8 and the tubing head spool 2 and a lower annulus port 15 opens into the annular space 16 between lower production tubing 7 and the spool 2 and above the casing hanger 5, so that it is in communication with the annular space 17 between tubing 7 and casing string 6. Annulus access routing between ports 15 and 13 is provided by the module 10 via an annulus master valve 18 in the module 10, a sensor in the form of an annulus pressure and temperature transducer 19 in the module 10 and an annulus workover valve 20 in the module 10, and suitable passageways in the module 10, typically provided by bores in it. The annulus master valve 18 and the annulus workover valve 20, which could be gate valves for example, are controlled from a typical subsea control module of the well installation and the transducer 19 is itself coupled to the subsea control module. Control signals to the actuators of valves 18 and 20 and signals to and from transducer 19 are via a disconnectable coupler pair, one half 21 being mounted via the tree 9 and the other hall 22 being mounted on the module 10 (and recoverable with it). The coupling of halves 21, 22 may be a retractable one (operable via a diver or a remotely operated vehicle (ROV)) or may be "self-mating". Pre-installed in the recoverable module 10 is a plug 23, the module 10 having an access point at 24 for movement of the plug by means of a remotely operated vehicle.

The wellhead assembly 1 of FIG. 1 is installed as follows. The tubing head spool 2 is put on the wellhead and a drilling system including a blowout preventer is installed onto it. A drilling system drills into the subsea formation and the string of casing 6 is installed suspended by casing hanger 5. Production tubing 7 on tubing hanger 3 is then installed inside the tubing head spool 2, the well now being completed. The blowout preventer is removed and the vertical tree 9 is installed on the tubing head spool 2 together with the tubing 8.

If it is detected that at least one of the valves 18, 20 is faulty and/or if the transducer 19 monitoring pressure and temperature produces an indication that there is a problem in the annular spaces 16 and 17, due to leaks or transients for example, then a downhole safety valve is operated and an ROV is used to move plug 23 through valve 18 to block the lower annulus port 15. Thereafter, the tree 9 is removed, for example on a wire, and an ROV is used to detach the module 10 from tubing head spool 2, by opening the attachment arrangement 12. Thereafter, the module 10 is recovered, for example on a wire, for repair or replacement.

Embodiments of the present invention avoid the necessity to recover the tubing head structure itself and the associated downhole well completion system. More particular, an advantage of the wellhead assembly 1 described above is that, in the event of a problem, there is no need to remove and recover the tubing head spool 2 or the associated downhole well completion system.

What is claimed is:

1. A subsea wellhead assembly comprising:

a tubing head structure with a tree above the tubing head structure; and a recoverable module attached around the tubing head structure below the tree, wherein the recoverable module sits on a support ring attached around the tubing head structure, the recoverable module comprising at least one valve and at least one sensor, wherein the recoverable module is detachably coupled to the tubing head structure using an openable and closeable attachment member.

2. The subsea wellhead assembly of claim 1, wherein the tubing head structure comprises a tubing hanger, wherein a lower production tubing extends from the tubing hanger to inside a well casing, and wherein an upper production tubing extends from the tubing hanger above the tubing hanger.

3. The subsea wellhead assembly of claim 2, wherein the tubing hanger sits on a shoulder in the tubing head structure.

4. The subsea wellhead assembly of claim 2, wherein the recoverable module provides annulus access routing between a lower port and an upper port, wherein the lower port is in communication with an annular space between the lower production tubing and the well casing, and wherein the upper port is in communication with an annular space between the upper production tubing and the tubing head structure.

5. The subsea wellhead assembly of claim 4, wherein the recoverable module provides the routing by a pathway between the lower port and the upper port, the pathway comprising the at least one valve and the at least one sensor.

6. The subsea wellhead assembly of claim 5, wherein the pathway comprises a sequence of an annulus master valve, a pressure and temperature sensor, and an annulus workover valve.

7. The subsea wellhead assembly of claim 4, wherein the recoverable module comprises a plug which is movable to close the lower port.

8. The subsea wellhead assembly of claim 1, wherein the recoverable module sits on an external support on the tubing head structure.

9. A method of operating a subsea well comprising;

providing a subsea wellhead assembly comprising a tubing head structure, with a tree above the tubing head structure and a recoverable module attached around the tubing head structure below the tree, wherein the recoverable module sits on a support ring attached around the tubing head structure, the recoverable module comprising at least one valve and at least one sensor; and removing the tree if a problem occurs in the operation of the subsea well, and, thereafter, removing the recoverable module from the tubing head structure, wherein the recoverable module is detachably coupled to the tubing head structure using an openable and closeable attachment member.

10. The method of claim 9, wherein the tubing head structure comprises a tubing hanger, wherein a lower production tubing extends from the tubing hanger to inside a well casing, and wherein an upper production tubing extends from the tubing hanger above the tubing hanger.

11. The method of claim 10, wherein the tubing hanger sits on a shoulder in the tubing head structure.

12. The method of claim 10, wherein the recoverable module provides annulus access routing between a lower port and an upper port, wherein the lower port is in communication with an annular space between the lower production tubing and the well casing, and wherein the upper port is in communication with an annular space between the upper production tubing and the tubing head structure.

13. The method of claim 12, wherein the recoverable module provides the routing by a pathway between the lower port and the upper port, the pathway comprising the at least one valve and the at least one sensor.

14. The method of claim 13, wherein the pathway comprises a sequence of an annulus master valve, a pressure and temperature sensor and an annulus workover valve.

15. The method of claim 12, wherein said recoverable module comprises a plug and wherein the method further comprises moving the plug to close the lower port before removing the tree and the recoverable module.

* * * * *